United States Patent [19]

Kaye

[11] 4,248,283

[45] Feb. 3, 1981

[54] COSMETIC PENCIL SHARPENER

[76] Inventor: Lowell Kaye, 14 Cottontail Rd., Melville, N.Y. 11746

[21] Appl. No.: 97,560

[22] Filed: Nov. 26, 1979

[51] Int. Cl.[3] ..... B43L 23/00

[52] U.S. Cl. ..... 145/3.31; 145/3.5; 145/3.61

[58] Field of Search ..... 145/3.1, 3.3, 3.31, 145/3.5, 3.6, 3.61

[56] References Cited

FOREIGN PATENT DOCUMENTS

| | | | |
|---|---|---|---|
| 79387 | 1/1950 | Czechoslovakia | 145/3.5 |
| 857915 | 12/1952 | Fed. Rep. of Germany | 145/3.31 |
| 1511450 | 8/1969 | Fed. Rep. of Germany | 145/3.31 |
| 2743120 | 3/1979 | Fed. Rep. of Germany | 145/3.5 |
| 2745600 | 4/1979 | Fed. Rep. of Germany | 145/3.31 |
| 486136 | 11/1953 | Italy | 145/3.31 |
| 130177 | 1/1929 | Switzerland | 145/3.5 |
| 979927 | 1/1965 | United Kingdom | 145/3.5 |

*Primary Examiner*—Othell M. Simpson
*Assistant Examiner*—J. T. Zatarga
*Attorney, Agent, or Firm*—Posnack, Roberts, Cohen & Spiecens

[57] ABSTRACT

A cosmetic pencil sharpener comprising a sharpener unit having a body of rectangular configuration embraced within a casing composed of upper and lower members separably engageable with one another and with the sharpener unit. A chip collector chamber is formed within the interior of the casing to receive shavings removed from the pencil during sharpening thereof. The upper and lower members have coextensive, elongate, cut-out portions, extending along mutually perpendicular sides to cooperatively define an L-shaped opening through which a portion of one of the sides and the front end of the body of the sharpener unit is exposed. In the exposed portion of the front end of the sharpener unit is an aperture leading to a bore in which the pencil to be sharpened is inserted.

15 Claims, 7 Drawing Figures

COSMETIC PENCIL SHARPENER

FIELD OF THE INVENTION

The invention relates to improvements in cosmetic pencil sharpeners.

PRIOR ART

Various configurations of pencil sharpeners are known and serve the general function of sharpening a cosmetic pencil, such as an eyeshadow pencil.

Also known are cosmetic pencil sharpeners having so-called chip collectors for collecting the shavings produced at the time of sharpening a pencil. The chip collectors vary in size in the different sharpeners and generally are capable of holding shavings from a multiplicity of sharpenings.

A typical cosmetic pencil sharpener with chip collector is shown in British Pat. No. 979,927. In this sharpener, as in other sharpeners of this type, the sharpener unit is totally enclosed within an outer casing except for the aperture in which the pencil is inserted. The outer casing forms the chip collector therewithin.

A further example of such a construction is shown in British Pat. No. 407,196; German Pat. No. 857,915; Italian Pat. No. 486,136; German Pat. Nos. 916,505, 845,020, and 1,051,165; and Czech Pat. No. 79,387.

A shortcoming of these patents is the total enclosure of the sharpener unit within the surrounding casing.

SUMMARY OF THE INVENTION

An object of the invention is to provide a construction in which the casing has judiciously placed cut-out portions so that a portion of a side wall and an end wall of the sharpener unit is exposed therethrough.

A further object of the invention is to provide a construction of the above type in which the casing members are separable and the separation is facilitated by exposing a portion of the sharpener unit which can be physically engaged for this purpose.

Another object of the invention is to provide a construction of the above type in which the cut-out portions of the casing allow engagement of the sharpener unit to hold the same in the course of sharpening a pencil.

A further object of the invention is to provide a pencil sharpener construction in which the surface appearance of the sharpener unit is distinctive with respect to the surrounding casing, and is evident through the cut-out portions.

Another object of the invention is to provide a pencil sharpener in which the constituent elements are easily assembled for operational purposes and are easily disassembled to empty the shavings collected in the course of sharpening.

Yet another object of the invention is to provide a construction of the above type in which the assembly of the sharpener is simplified by virtue of the configuration of the constituent elements thereof.

Another object of the invention is to provide a pencil sharpener which is compact and composed of all flat surfaces and is easy to engage and to disengage.

In order to realize the above and further objects of the invention, there is provided a cosmetic pencil sharpener comprising a sharpener unit of rectangular configuration having a top, a bottom, parallel sides and parallel front and rear ends with an aperture at the front end leading into a conical bore sized to receive a cosmetic pencil to be sharpened. The sharpener unit carries a blade which is operatively positioned with respect to the bore to sharpen a cosmetic pencil inserted thereinto. A casing for the sharpener unit is comprised of upper and lower separable casing members of rectangular configuration conforming to the sharpener unit and separably engageable with one another and with the sharpener unit for embracing the sharpener unit. The sharpener unit and the casing members form a chip collector chamber for shavings removed from the pencil during sharpening thereof. The construction is characterized by the provision of co-extensive, elongate cut-out portions in the upper and lower members extending along mutually perpendicular sides to cooperatively define an L-shaped slot or opening through which a portion of one of the sides and the front end of the sharpener unit is exposed, inclusive of the aperture for the cosmetic pencil.

In accordance with a feature of the invention, the sharpener unit is differentiated in surface appearance from the casing members so as to present a distinctive appearance in said L-shaped opening.

The differentiated surface appearance can be obtained by making the sharpener unit a different color from the casing members.

Further features and advantages of the construction according to the invention will become apparent from the following detailed description taken in conjunction with the attached drawings.

DETAILED DESCRIPTION

Figure 1:
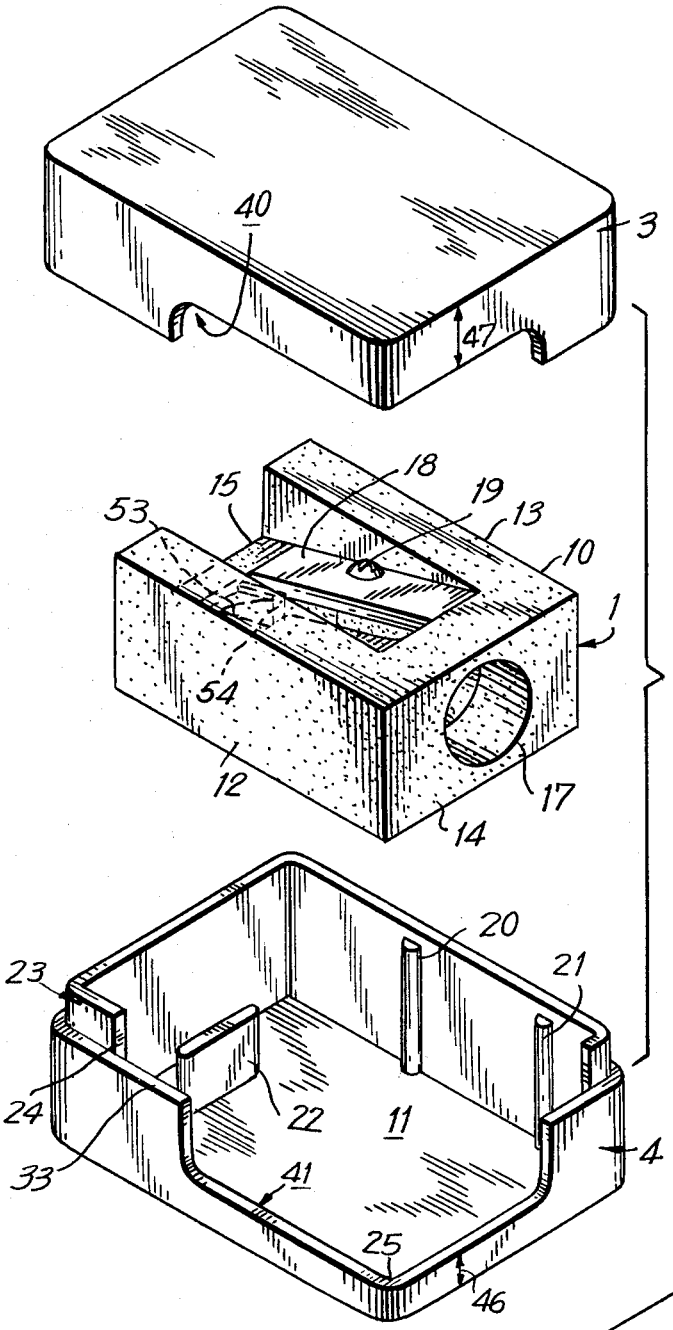
FIG. 1 is an exploded perspective view of the cosmetic pencil sharpener according to the invention.
Figure 2:
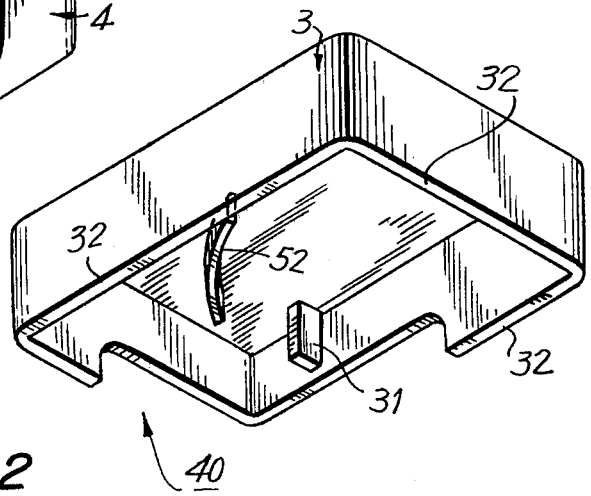
FIG. 2 is a bottom perspective view of an upper casing member of the cosmetic pencil sharpener.

The cosmetic pencil sharpener comprises a sharpener unit 1 and a casing 2 comprising upper casing member 3 and lower casing member 4. The upper and lower casing members are separably engageable with one another and with the sharpener unit 1 for embracing the sharpener unit as evident in FIG. 3.

In the engaged position of the sharpener unit in the casing members, a first space 5 is formed at the rear of the sharpener unit, and a second space 6 is formed at the top of the sharpener unit. The first and second spaces 5 and 6 communicate with one another to collectively form a chip collector chamber 7 for receiving shavings removed from the pencil during sharpening thereof.

In order to remove the accumulated shavings from the casing, the casing members 3 and 4 are separated, and the shavings are emptied. The casing members 3 and 4 are then re-assembled with the sharpener unit 1 for subsequent use.

The sharpener unit 1 is of rectangular configuration and the casing members 3 and 4 are of corresponding rectangular configuration conforming to that of the sharpener unit.

The sharpener unit comprises a body having a top 10, a bottom 11, parallel sides 12, 13, and parallel front and rear ends 14 and 15 respectively.

The sharpener unit has a conical bore 16 with an aperture 17 at the front end sized to receive a cosmetic pencil to be sharpened. A blade 18 is secured by a fastener 19 adjacent the bore 16 for sharpening a cosmetic pencil inserted into the bore.

The lower casing member 4 is provided with positioning means for releasably engaging the sharpener unit and for guidably positioning the sharpener unit in the lower casing member.

The positioning means includes a number of positioning surfaces disposed to engage the sharpener unit along the sides, top and ends thereof.

Figure 6:
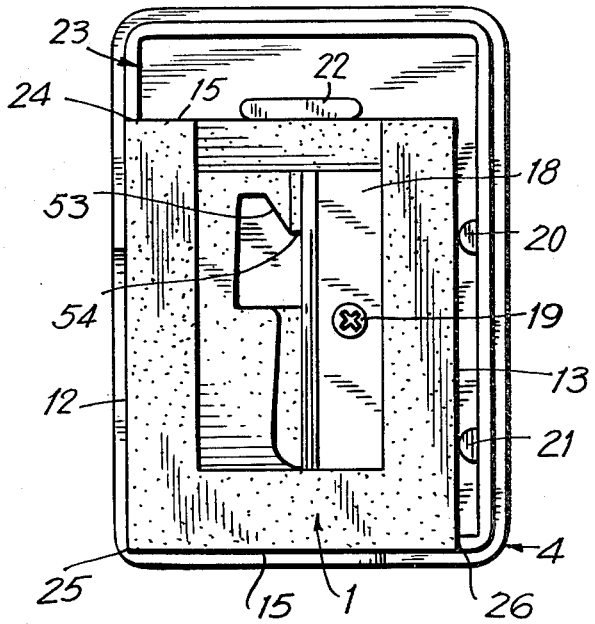
FIG. 6 is a top perspective view of the cosmetic pencil sharpener with the upper casing member thereof removed.

The positioning means comprises ribs 20 and 21 extending along the height of a lateral side of the lower casing member 4, and an upward projection 22 on the bottom 11 of the lower casing which is positioned to contact the rear end 15 of the sharpener unit in the assembled position. A shelf 23 for engaging the upper casing member 3 has a front end 24 positioned to engage the rear end 15 of the sharpener unit as best seen in FIG. 6. A right-angled corner 25 is formed in the lower casing member to engage one corner at the front end of the sharpener unit 1, and the shelf 23 forms a second right-angled corner 26 at the other edge at the front end 14 of the sharpener unit 1.

As a consequence, when the sharpener unit is inserted into the lower casing, it rests on the bottom thereof and is securely engaged along its sides and ends so as to be tightly held in position. The sharpener unit 1 is normally removable from the lower casing, but in certain circumstances, it may be desirable to fixedly secure the sharpener unit in the lower casing and for this purpose, an adhesive substance is applied on the positioning surfaces of the lower casing and the corresponding surfaces of the sharpener unit.

Figure 5:
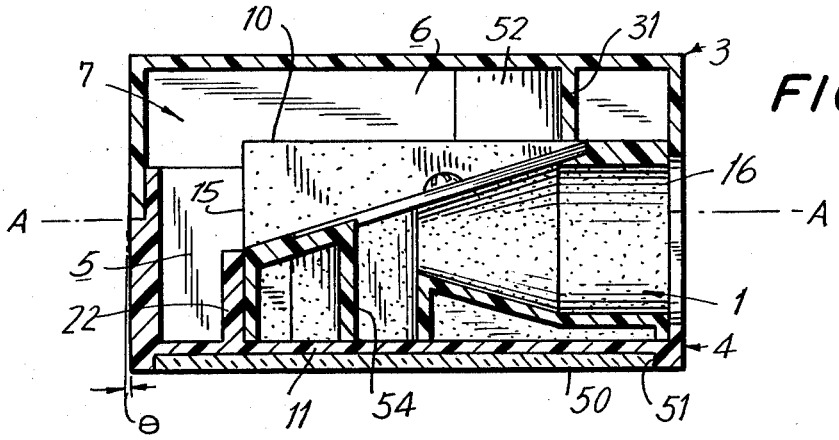
FIG. 5 is a longitudinal sectional view through the sharpener taken along plane 5—5 in FIG. 3.

The inner surface of the walls of the upper casing member 3 frictionally engages the outer surface of the shelf 23 to frictionally interfit the casing members and embrace the sharpener unit. In order to facilitate the interengagement of the casing members, the walls thereof are provided with a slight draft represented by the angle $\theta$ in FIG. 5 of the order of 2°–4°.

The upper casing member 3 has a positioning rib 31 which contacts the upper surface 10 of the body of the sharpener unit to limit the extent of engagement of the upper casing member with the lower casing member.

The height of the positioning rib 31 is such that when the rib 31 contacts the upper surface 10, the lower edge 32 of the upper casing member 3 will seat on the upper edge 33 of the lower casing member 4 while the shelf 23 will frictionally interfit with the inner surface of the upper casing member concurrently, the rib 31 will press the sharpener unit against the bottom of the lower casing member 4 so that there is snug interengagement between the casing members and the sharpener unit.

Figure 3:
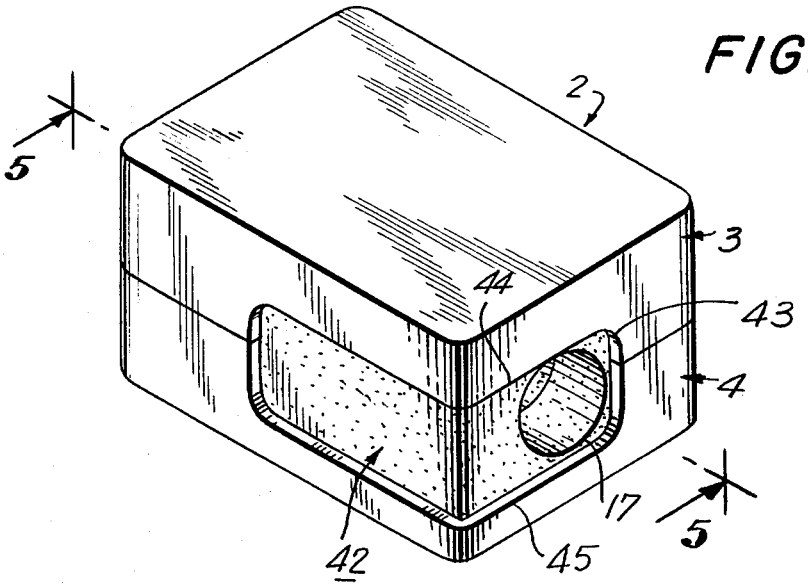
FIG. 3 is a front perspective view of the assembled cosmetic pencil sharpener of FIG. 1.
Figure 4:
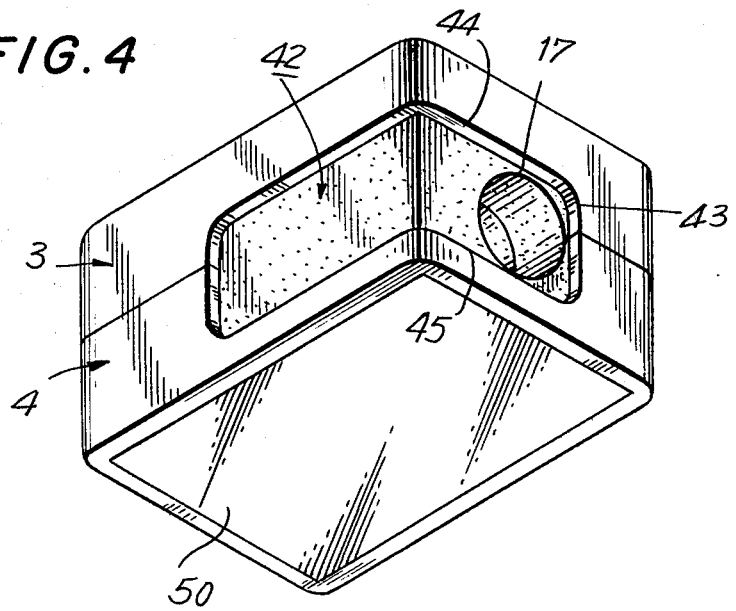
FIG. 4 is a bottom perspective view of the cosmetic pencil sharpener.

The upper casing member is provided with a cut-out portion 40 and the lower casing member is provided with a cut-out portion 41, these cut-out portions extending along mutually perpendicular sides of the casing members to cooperatively define and L-shaped opening or slot 42 through which a portion of side 12 and front end 14 of the sharpener unit is exposed. As seen in FIG. 3, the aperture 17 is also exposed through the L-shaped opening 42, and the aperture is substantially tangent to the bounding edge 43 formed by the edges of the cut-out portions 40 and 41. In the embodiment of FIG. 3, the upper and lower bounding edges 44 and 45 of the cut-out portions 40 and 41 are also substantially tangent to the aperture 17 of the sharpener unit. Thereby the depth of the L-shaped opening 42 represents the maximum diameter of the cosmetic pencil which can be inserted into the sharpener.

The L-shaped opening 42 also serves as an access slot in which a finger of the user can be engaged to apply direct lateral pressure to the sharpener unit in the course of sharpening to hold the sharpener unit directly in place.

Moreover, the L-shaped opening 42 allows manual engagement of the sharpener unit to facilitate the separation of the upper casing member 3 from the sharpener when shavings are to be removed from the chip collector chamber.

Additionally, the L-shaped slot 42 exposes the surfaces of the body of the sharpener unit and allows for the placement of indicia on the body of the sharpener unit which will be visible through the slot 42 when the casing members have been assembled on the sharpener unit.

Furthermore, because of the L-shaped slot 42, the body of the sharpener unit can be differentiated in surface appearance from the casing members so as to present a distinctive appearance in the slot. The differentiated appearance of the sharpener unit can be provided by making the body of the sharpener unit a different color from that of the casing members.

Numerous additional possibilities are provided to effect the distinctive appearance of the sharpener unit through the slot, and by way of example, the sharpener unit can be provided with various finishes such as electroplating, tortoise shell, pearlized, marbleized, and the like.

The sharpener unit and casing members are preferably made of a plastic material, such as general purpose styrene, ABS, and the like.

The provision of the L-shaped slot also facilitates the orientation of the casing members during engagement and disengagement and in the engaged position of the casing members provides rapid and easy location of the aperture for insertion of the pencil.

The cut-out portions 40,41 extend in each of the mutually perpendicular sides of the casing members over more than half the length thereof in order that the L-shaped slot can satisfy the functions as indicated previously.

In order to distinguish the upper and lower casing members from one another and to facilitate the engagement thereof with the sharpener unit, the cut-out portions are of different depth in the upper and lower casing members so that the L-shaped slot is offset downwardly with respect to the central plane A—A along which the casing members abut one another.

As seen, the cut-out portion 41 in the lower casing member 4 is of greater depth than the cut-out portion 40 in the upper casing member 3 whereby the remaining wall height 46 in the lower casing member is less than the wall height 47 in the upper casing member.

Since the cosmetic pencil sharpener is generally used in conjunction with a cosmetic pencil adapted for application to the face of the user, there is advantageously provided a mirror 50 mounted in a recess 51 in the bottom of the lower casing member 4. As an alternative to the provision of mirror 50, the bottom of the lower casing member 4 may be provided with a mirrored surface. In this way, the user can sharpen the cosmetic pencil and employ the sharpened pencil while looking in the mirrored surface. The L-shaped opening 42 has advantage in this regard in that the sharpener can be held with finger-engagement of the sharpener unit, which insures the assembly of the elements of the sharpener during turning and handling of the sharpener.

In order to prevent accumulation of shavings in the region of the sharpener blade 18, it has been found advantageous to provide an internal guide means in the form of curved guide member 52 projecting from the inner surface of the upper casing member 3 toward the blade 18. The curved guide member 52 guides the shavings from the pencil into the chip collector chamber 7 away from the blade 18 and prevents accumulation of shavings and blockage of the blade.

In order to form a blunt-edge on the pencil rather than a sharp edge, which is undesired in usage, the body of the sharpener unit is provided with an integral tapered projection 53, extending beneath the sharpener blade 18 and provided with a flat edge 54 which comes into contact with the end of the pencil when the latter is inserted into the bore in the sharpener unit. As a consequence, the edge of the sharpened pencil will be blunted by edge 54 and preclude the formation of a point.

Figure 7:
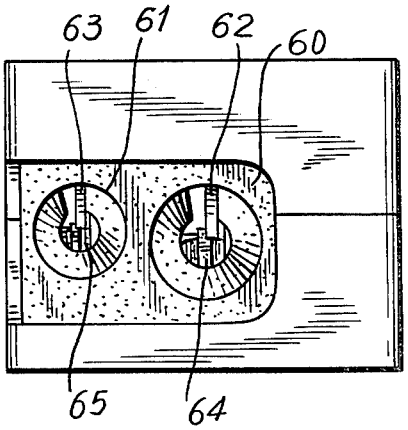
FIG. 7 is a front view of a modified cosmetic pencil sharpener.

The sharpener, which has been illustrated in FIGS. 1–6, shows the maximum diameter of pencil which can be sharpened with the sharpener. In this regard, the bore 16 is of maximum size and the aperture 17 is a maximum and corresponds in diameter to the height of the L-shaped opening 42. When the sharpener is intended for use with pencils of a smaller diameter, the size of the bore and aperture are adjusted accordingly. A number of different sharpener units may be employed with the same casing members. For this purpose, the separability of the sharpener unit from the lower casing member is of substantial advantage. In the embodiment shown in FIG. 7, a modified sharpener unit is illustrated wherein two bores of different diameter with corresponding apertures 60 and 61 are shown. The sharpener unit employes a separate blade 62 and 63 for each of the bores and a respective blunting edge 64 and 65. The transverse length of the elongate L-shaped slot can be increased if necessary, as illustrated in FIG. 7, in order to accommodate the sharpener unit with the two bores.

Although the invention has been described in conjunction with preferred embodiments thereof, it is to be understood that various modifications and variations can be made without departing from the scope and spirit of the invention as defined in the appended claims.

What is claimed is:

1. A cosmetic pencil sharpener comprising a sharpener unit including a body of rectangular configuration having a top, a bottom, parallel sides and parallel front and rear ends, said sharpener unit further having a conical bore with an aperture at said front end sized to receive a cosmetic pencil to be sharpened, sharpener means on said sharpener unit operatively positioned with respect to said bore for sharpening a cosmetic pencil inserted thereinto, and upper and lower separable members constituting a casing for said sharpener element, said upper and lower members being of rectangular configuration conforming to that of said sharpener unit and being separably engageable with one another and with said sharpener unit for embracing said sharpener unit, said sharpener unit being engaged by said casing members to provide a first space therewith at said rear end and a second space between the top of the sharpener unit and said upper casing member, said first and second spaces communicating with one another to form a chip collector chamber for shavings removed from the pencil during sharpening thereof, said upper and lower members having co-extensive elongate cut-out portions extending along mutually perpendicular sides cooperatively defining an L-shaped opening through which a portion of one of said sides and the front end of said body of said sharpener unit is exposed inclusive of said aperture.

2. A cosmetic pencil sharpener as claimed in claim 1 comprising positioning means on said lower casing member for releasably engaging said sharpener unit and for guidably positioning said sharpener unit in said lower casing member.

3. A cosmetic pencil sharpener as claimed in claim 2 wherein said positioning means includes positioning surfaces disposed to engage the body of the sharpener unit along the sides and ends thereof.

4. A cosmetic pencil sharpener as claimed in claim 3 wherein said positioning surfaces are located to engage the sides and ends of the sharpener unit outside said opening formed by said cut-out portions.

5. A cosmetic pencil sharpener as claimed in claim 1 comprising means for providing a frictional fit between said upper and lower casing members and said sharpener unit.

6. A cosmetic pencil sharpener as claimed in claim 1 wherein said cut-out portions extend partially in each of said mutually perpendicular sides of the casing members over more than half the length thereof.

7. A cosmetic pencil sharpener as claimed in claim 1 wherein said casing members abut one another along a central plane, said cut-out portions being of different depth in said upper and lower casing members whereby said L-shaped opening is offset downwardly with respect to said central plane.

8. A cosmetic pencil sharpener as claimed in claim 7 wherein said cut-out portion is of greater depth in said lower casing member whereby the remaining wall height in the lower casing member is less than that on the upper casing member.

9. A cosmetic pencil sharpener as claimed in claim 8 wherein said L-shaped opening in the casing has a bounding edge, said aperture in said sharpener unit being substantially tangent to said bounding edge and to the edges of the cut-out portions.

10. A cosmetic pencil sharpener as claimed in claim 1 comprising internal guide means projecting from said upper casing member towards said sharpener means for guiding the shavings from said pencil into the chip collector chamber.

11. A cosmetic pencil sharpener as claimed in claim 1 wherein said lower casing member has an outer bottom mirrored surface.

12. A cosmetic pencil sharpener as claimed in claim 1 wherein said body of said sharpener unit is differentiated in surface appearance from said casing members so as to present a distinctive appearance in said L-shaped opening formed by said cut-out portions.

13. A cosmetic pencil sharpener as claimed in claim 12 wherein said differentiated surface appearance of the sharpener unit is provided by a different color of the sharpener unit as compared to said casing members.

14. A cosmetic pencil sharpener as claimed in claim 1 wherein said sharpener unit and casing members are made of plastic.

15. A cosmetic pencil sharpener as claimed in claim 1 wherein said front end of said body of said sharpener unit is provided with a second aperture of a different size from the first said aperture and with a sharpener means associated with the second aperture to enable pencils of different diameter to be sharpened.

* * * * *